US005757389A

United States Patent [19]

Schwede et al.

[11] Patent Number: 5,757,389

[45] Date of Patent: May 26, 1998

[54] PRINTING DEVICE FOR OBJECTS, WHICH ARE CONTINOUSLY MOVED FORWARD, IN PARTICULAR FOR PARCELS, WRAPPED MAGAZINE PILES OR THE LIKE

[75] Inventors: Horst Schwede, Rosenstrasse 22, D-95463 Bindlach; Roland Schwede, Furtwänglerstrasse lo, D-95445 Bayreuth; Helmut Schmetzer, Bayreuth, all of Germany

[73] Assignees: Horst Schwede, Bindlach; Roland Schwede, Goldkronach, both of Germany

[21] Appl. No.: 389,204

[22] Filed: Feb. 15, 1995

Related U.S. Application Data

[63] Continuation-in-part of Ser. No. 947,447, Sep. 21, 1992, abandoned.

[30] Foreign Application Priority Data

Sep. 25, 1991 [DE] Germany ..... 41 31 911.7

[51] Int. Cl.[6] ..... B41J 2/01

[52] U.S. Cl. ..... 347/4; 347/8; 346/136

[58] Field of Search ..... 347/4, 8; 346/136, 346/139 A

[56] References Cited

U.S. PATENT DOCUMENTS

| | | | |
|---|---|---|---|
| 4,349,405 | 9/1982 | Dudzik | 156/358 |
| 4,580,914 | 4/1986 | Rich et al. | 400/56 |
| 4,825,091 | 4/1989 | Breyer et al. | 250/560 |
| 4,989,255 | 1/1991 | Manns et al. | 383/8 |
| 5,102,110 | 4/1992 | Reynolds | 270/11 |

FOREIGN PATENT DOCUMENTS

| | | |
|---|---|---|
| 0038630 | of 1990 | European Pat. Off. . |
| 0088630 | of 1990 | European Pat. Off. . |

*Primary Examiner*—N. Le
*Assistant Examiner*—Craig A. Hallacher
*Attorney, Agent, or Firm*—Laff, Whitesel, Conte & Saret, Ltd.

[57] ABSTRACT

A printing device for objects, which are continuously moved forward, in particular for parcels, wrapped magazine piles or the like, comprises a transport path, alongside of which the objects can be transported at a defined rate of feed. By means of an adjustable matrix printing head the surface to be printed of the objects can be printed in contactless manner when they pass the printing head. A scanning member, related to the transport direction of the objects, is arranged at a distance before the printing head. The scanning member scans the position of the surface to be printed of the objects and tracks the printing head according to the position of the surface to be printed of the objects by a corresponding control of an adjustment drive of the printing head.

11 Claims, 3 Drawing Sheets

PRINTING DEVICE FOR OBJECTS, WHICH ARE CONTINOUSLY MOVED FORWARD, IN PARTICULAR FOR PARCELS, WRAPPED MAGAZINE PILES OR THE LIKE

This is a continuation-in-part of our application Ser. No. 07/947,447 filed Sep. 21, 1992, abandoned.

FIELD OF THE INVENTION

The invention relates to a printing device for objects, which are continuously moved forward, in particular for parcels, wrapped magazine piles or the like.

BACKGROUND OF THE INVENTION

When storing or dispatching wrapped magazine piles, which, to simplify matters, are all specified in the following as an example for the objects under discussion, there exists basically the problem that information on the contents, the addressee and the like of the magazine pile must be available on the wrapper of the magazine pile. To this effect for example adhesive labels, which are accordingly printed, are used. It is also known to enclose a cover sheet with the appropriate information on the upper side of magazine piles which are welded in transparent foils, which sheet can be read through the transparent plastic cover. The disadvantage here is that this works only with transparent wrappers of plastic material. Furthermore the individual handling of the individual supplementary sheet, when mechanically piling and wrapping the magazines, is problematic, in particular with regard to the fact that different magazine piles may have different heights.

SUMMARY OF THE INVENTION

It is an object of the invention to provide a printing device for objects, which are continuously moved forward, in particular for parcels, wrapped magazine piles or the like, with the help of which objects can be printed directly, fully automatically and without interrupting their transport flow within the printing device.

This object is attained by a printing device for printing symbols onto objects, which are continuously moved forward, in particular for parcels and wrapped magazine piles with a transport device, comprising a drive and a transport path driven by the drive, alongside of which objects of different height can be continuously transported at a defined speed in a transport direction, a printing unit, comprising at least one matrix printing head, which is arranged vertically above the transport path, and which in contactless manner prints symbols onto an upper side of the objects, when they pass the at least one matrix printing head, and an adjustment drive for the at least one matrix printing head, by means of which adjustment drive the print position of the at least one matrix printing head can be adapted to a height position of the respective upper side of the objects to be printed, and a first scanning means, which is arranged vertically above the transport path, which, related to the transport direction of the objects, is arranged at a distance before the printing head, which scans the height position of the upper side of the objects to be printed and by means of which the at least one matrix printing head can track the height position of the upper side of the objects to be printed by a corresponding control of the adjustment drive. The device according to the invention is advantageous in that by the contactless printing of the objects under discussion during their forward movement this device can be integrated as it were "in seamless manner" into a fully automatic printing, sorting, bundling and wrapping line for magazines. By means of the use of a matrix printing head with one and the same printing head the most different kind of information such as different addressees, magazine titles, issue quantities and the like can be put onto the different magazine piles without any significant adaptation works. Furthermore the printing device is able to fully automatically adapt to different heights of piles (in case the upper side of the pile is printed) by means of its scanning means and the adjustment drive controlled by the scanning means for adjusting the matrix printing head. In addition, the scanning means prevents the matrix printing head from coming into contact with a pile and thus from being damaged. Also an interruption of the flow of the piles is thus avoided. This increases the reliability of the device.

It is especially worth mentioning the advantage that, when accordingly embodying the adjustment drive and the scanning means, a continuous detection of the form of the surface to be printed of each object and an accordingly adapted tracking of the printing head, when this surface passes the printing head, are possible. By this effect also extremely uneven surfaces of objects, as is often the case with especially high magazine piles, can be imprinted without any problems and in high printing quality.

Further features, details and advantages of the invention will become apparent from the dependent claims and from the ensuing description, in which two examplary embodiments of the invention are described in detail, taken in conjunction with the drawing.

DESCRIPTION OF THE PREFERRED EMBODIMENTS

Figure 1:
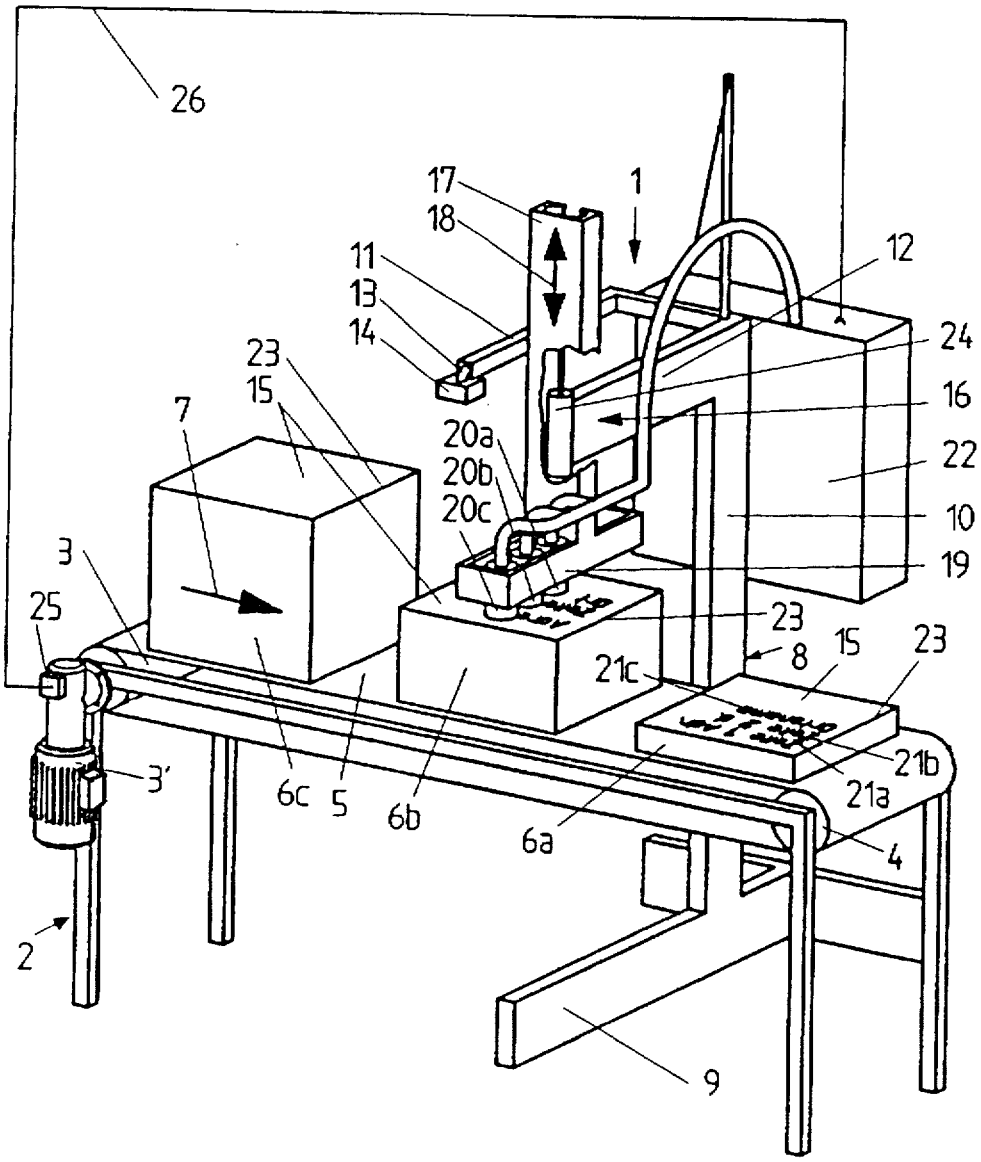
FIG. 1 shows a diagrammatical perspective illustration of a first embodiment of a printing device according to the invention.

According to FIG. 1 a transport table 2 is associated with the printing device 1, which transport table 2 carries a conveyor belt 5 via two rotatably supported deflection pulleys 3, 4. The deflection pulley 3 comprises a rotational drive in the form of a motor 3'. The transport table 2 with conveyor belt 5 can also be a part of an oblong transport path of a printing, cutting, sorting and bundling line for newspapers or magazines.

By means of the conveyor belt 5 magazine piles 6*a*, 6*b*, 6*c* of different heights, which are wrapped with packing paper for dispatch, are fed to the printing device 1 in the transport direction 7.

The printing device 1 comprises a stand 8 with a foot 9 and a standard 10 projecting upwards, which continues in two horizontal extension arms 11, 12, which are parallel in relation to each other. At the free end 13 of the first extension arm 11 seen in the transport direction 7 an infrared distance sensor 14 is disposed as a scanning means for the position of the upper side 15 to be printed of the magazine piles 6*a*, 6*b*, 6*c*. The infrared distance sensor 14 is arranged approximately centrically with respect to the width of the conveyor belt 5 and vertical over the latter in a height, which is higher than the desired maximum height of the magazine piles 6*a*, 6b, 6c. In lieu of an infrared distance sensor 14 also an ultrasonic distance sensor can be used. Both types of sensor are scanning means, which measure in contactless manner and which have a high measuring accuracy and operational reliability.

At the free end 16 of the second extension arm 12, which related to the transport direction 7 is located behind the first extension arm 11 the vertically arranged adjustment arm 17 is disposed. This adjustment arm 17 is supported at the extension arm 12 displaceable in the vertical direction of adjustment 18 by means of an adjustment drive in the form of a pneumatic piston cylinder drive 24. Pneumatic piston cylinder drives of this type for the adjustment arm of this type are commercial drives, which means they are perfected, reliable and controllable without any problems. At its lower end the adjustment arm 17 carries a carrier 19, which extends horizontally and across the transport direction 7, at which carrier 19 three ink jet matrix printing heads 20a, 20b, 20c are arranged side by side in the transport direction 7 with an ink jet direction which directs vertically downward. Printing heads of this type are commercial and attain a highcontrast and thus well recognizable printing style. Furthermore their special merits are high reliability. Each of the ink jet matrix printing head 20a, 20b, 20c is associated to one of the three printing lines 21a, 21b, 21c respectively on the upper side 15 of the magazine piles 6a, 6b, 6c.

By means of its adjustment drive the adjustment arm 17 is progressively adjustable between an upper and a lower end position. In the upper end position of the adjustment arm 17 the ink jet matrix printing heads 20a, 20b, 20c are located in a height vertical over the conveyor belt 5, which height analogue to the arrangement of the infrared distance sensor 14 is higher than the desired maximum height of the magazine piles 6a, 6b, 6c. In its lower end position the ink jet matrix printing heads are located one to a few centimeters above the conveyor belt 5, so that also very low magazine piles or also for example only one wrapped single issue of a magazine can be printed.

At the standard 10 of the printing device 1 furthermore a central control unit 22, which is controlled by a microprocessor, is disposed, by means of which the entire printing device 1 is controllable. In particular, it is possible to centrally conduct the printing control of the printing heads and the control of their adjustment drive while evaluating the measuring signals of the scanning means (infrared sensor 14). Beyond that the microprocessor control opens the possibility to recall texts stored in data memories, printing styles or the like by corresponding operational commands and to print the different magazine piles to be printed by the printing device individually—for instance according to the respective number of issues, the respective addressee or the respective magazine title. The input of the control unit 22 is connected with the infrared distance sensor 14 for receiving the measuring signals of the latter. The outputs of the control unit 22 are connected with corresponding valves of the pneumatic adjustment drive of the adjustment arm 17 as well as with the corresponding inputs of the ink jet matrix printing heads 20a, 20b, 20c for their printing control. Since the controlling of the commercial pneumatic drives or the printing control of the commercial ink jet matrix printing heads 20a, 20b, 20c is known, a detailed description is not necessary.

Via a corresponding keyboard (not shown) at the control unit 22 texts, which are to be printed onto the upper side 15 of the magazine piles 6a, 6b, 6c, can be fed to the control unit 22. Texts of this type can also be stored on internal or external data memories and can be recalled for printing via corresponding control commands, which are fed, if necessary, via on-line connections with central control units to a production line for magazines.

The printing device 1 functions as follows:

As soon as a magazine pile 6a, 6b, 6c arrives in the scanning region vertically below the infrared distance sensor 14, the output signal of the infrared distance sensor 14 changes from a value, which corresponds to its distance from the conveyor belt 5, to a value, which corresponds to its distance to the upper side 15 of the corresponding magazine pile 6a, 6b, 6c. In this manner, when the very low magazine pile 6c passes through, an output signal is delivered, which corresponds to a very high distance value, whereas with the very high magazine pile 6a an output signal is delivered, which corresponds to a very low distance value. By means of the discontinuous change of the measuring signal, when the corresponding magazine pile 6a, 6b, 6c arrives in the scanning region of the infrared distance sensor 14, also the position of the front edge 23 of the magazine pile 6a, 6b, 6c is displayed. The corresponding measuring signal is evaluated by the control unit 22, which in turn adjusts the adjustment arm 17 via the pneumatic adjustment drive within a period, which is required by the corresponding magazine pile 6a, 6b, 6c for the forward movement from the infrared distance sensor 14 to the ink jet matrix printing heads 20a, 20b, 20c, to a height, in which the printing heads 20a, 20b, 20c are arranged approximately half a centimeter to one centimeter over the upper side 15 of the corresponding magazine pile 6a, 6b, 6c. As the magazine piles 6a, 6b, 6c are transported through the conveyor belt 5 with a defined rate of feed, also the moment is sufficiently defined, at which the front edge 23 of the corresponding magazine pile 6a, 6b, 6c has passed the ink jet matrix printing heads 20a, 20b, 20c. At this moment the contactless printing action of the printing heads 20a, 20b, 20c can start, which each put the associated printing line 21a, 21b, 23c by spraying ink onto the upper side of the magazine pile 6a, 6b, 6c.

In connection with the rate of feed of the magazine piles 6a, 6b, 6c it must be referred to the fact that the corresponding speed of the conveyor belt can also be detected via a tachogenerator 25, which is coupled to the motor 3' and which is connected via a signal line 26 with the control unit 22. The latter evaluates the speed of the magazine piles 6a, 6b, 6c and thereof can exactly control the starting moment of the printing process after receipt of a corresponding signal of the infrared distance sensor 14.

As the upper side 15 of the magazine piles 6a, 6b, 6c is continuously detected, when it passes the infrared distance sensor 14, also a form of the upper side 15 which is not even can be registered and the ink jet matrix printing heads 20a, 20b, 20c can track the actual form of the upper side 15 during the printing process delayed in time.

Figure 2:
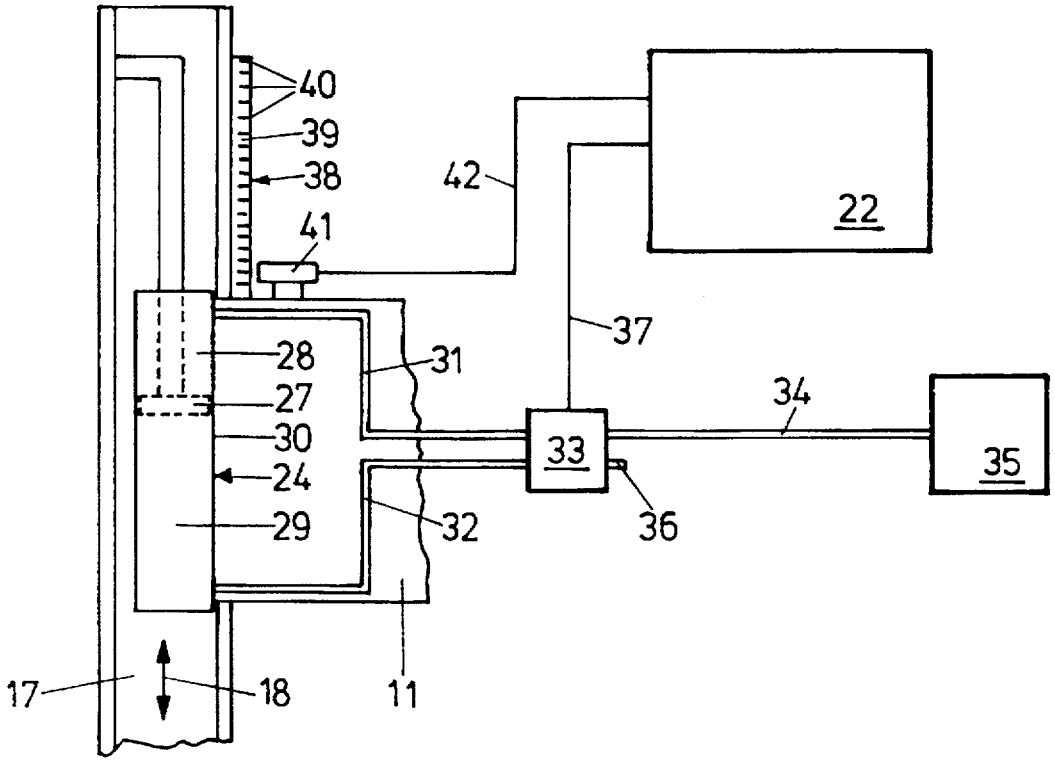
FIG. 2 shows a diagrammatical side view of the adjustment drive for the printing unit of the printing device.

From FIG. 2 the controlling of the piston cylinder drive 24 as well as the detection of the position of the adjustment arm 17 and thus of the ink jet matrix printing heads 20a, 20b, 20c relative to the transport path (conveyor belt 5) becomes clear.

The working spaces (28, 29), which are arranged on both sides of the piston 27 of the cylinder 30 of the piston cylinder drive 24 are each connected with a multipath control valve 33 via a pneumatic line 31, 32. The multipath control valve 33 in turn is connected with a printing source in the form of a pump 35 via a further pneumatic line 34, which pump 35 delivers a constant supply pressure $P_{max}$. At the same time the multipath control valve 33 is provided with an atmospheric supply 36, with which it can be connected with the atmosphere. Via an electric control line 37 the multipath control valve 33 is connected with the control unit 23, which controls the control valve 33 in such manner that the pressure values in both of the working spaces (28, 29) of the cylinder (30) can be adjusted independent from each other to values between the supply pressure $P_{max}$ of the pump (35) and the atmospheric pressure $P_{atm}$. Via these different pressure values in both of the working spaces 28, 29 the acceleration and thus the adjustment speed, with which the adjustment arm 17 is moved into its printing position, can be adapted to practical requirements. In case of a large necessary movement of the adjustment arm 17 for example in the vertical upward direction the lower working space 29 is driven with the supply pressure $P_{max}$, whereas in the upper working space 28 atmospheric pressure is adjusted with the help of the multipath control valve 33. By means of this a maximum possible difference pressure is prevailing between both working spaces 28, 29, so that the adjustment of the adjustment arm 17 is performed with maximum acceleration and thus at a maximum speed. In order to achieve an accurate positioning of the adjustment arm 17, the (low) pressure in the upper working space 28 can be increased and the (high) pressure in the working space 29 can be decreased approximately at the end of the way of adjustment via the control unit 22, for the adjustment arm 17 to be reduced in speed and be moved in its desired position. This means insofar that the multipath control valve 33 also has throttling properties, as in both of the working spaces 28, 29 pressure values can be adjusted, which range between the supply pressure pmax and the atmospheric pressure $P_{atm}$.

In order to be able to detect the position of the printing heads 20*a*, 20*b*, 20*c* relative to the conveyor belt 5 and their way of adjustment, an incremental position detecting means 38 is provided at the adjustment arm 17, which on the one hand carries a marking rail in the form of a so-called glass scale 39, which is arranged at the adjustment arm 17. This glass scale 39 comprises markings 40, which in the direction of adjustment 18 are arranged in equidistant manner towards each other. On the other hand the position detecting means 38 comprises a marking sensor 41, which is arranged in stationary manner at the extension arm 11, and which incrementally detects the passing of each of the markings 40, and which transmits this passing in the form of a corresponding electric signals to the control unit 22 via the signal line 42. Insofar the control unit 22 can process the transmitted signals in the manner which is usual with incremental position detecting means and can determine the position of the adjustment arm 17 at any moment.

Figure 3:
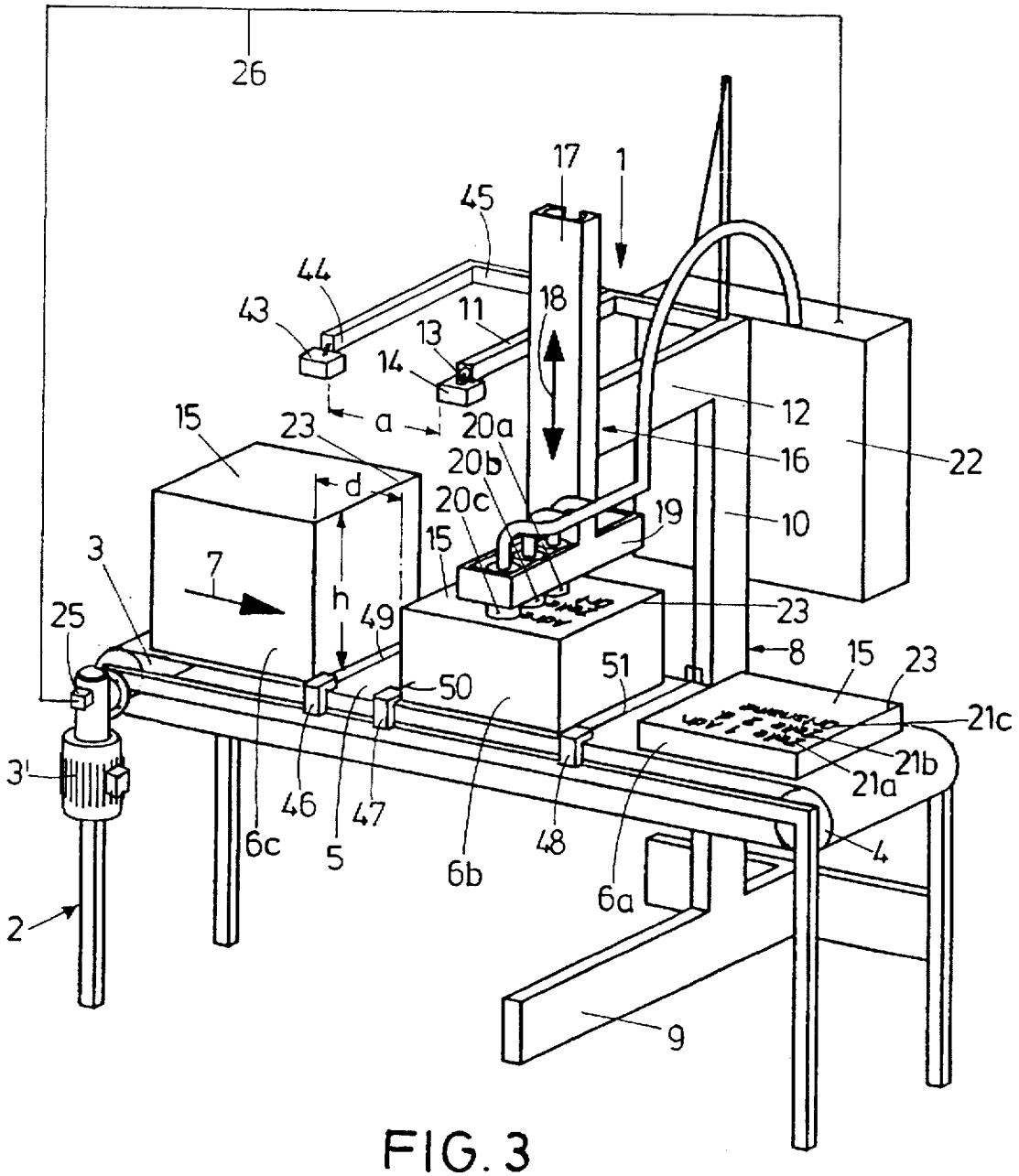
FIG. 3 shows a diagrammatical perspective illustration of a second embodiment of a printing device according to the invention.

FIG. 3 illustrates a second embodiment of the printing device 1' according to the invention. A lot of components of this embodiment correspond to the embodiment according to FIG. 1. Identical components, therefore, have identical reference numerals and need no renewed explanation.

The following is an explanation of the main differences in structure and function of the printing device 1':

In addition to the infrared distance sensor 14, the printing device 1' comprises a second infrared distance sensor 43 of this kind, which is mounted on the free end 44 of an extension arm 45. The extension arm 45 is fastened to the extension arm 11 of the first infrared distance sensor 14 in such a way and is of such shape that the infrared distance sensor 43 is disposed on a level with the infrared distance sensor 14 vertically above the conveyor belt 5, but, referred to the transport direction 7, at a distance a upstream of the infrared distance sensor 14. Furthermore, the infrared distance sensor 43 is connected with the control unit 22 by way of a signal line not shown.

Three light barriers 46, 47, 48, again connected with the control unit 22 by way of signal lines not shown, are disposed along the conveyor belt 5. These light barriers 46, 47, 48 substantially serve to detect the respective position of the individual magazine piles 6*a*, 6*b*, 6*c* in relation to the transport direction 7.

Referred to the transport direction 7, the first light barrier 46 seen in this direction is disposed short of the infrared distance sensor 43. As soon as a magazine pile (6*c* of FIG. 3) interrupts the beam 49 of the light barrier 46, the latter emits a corresponding signal to the control unit 22. So the light barrier 46 indicates that a magazine pile 6*c* has arrived in the scanning region of the infrared distance sensor 43.

The second light barrier 47 referred to the transport direction 7 is disposed laterally to the conveyor belt 5 in a position between the infrared distance sensors 43 and 14. If its beam 50 is interrupted by an arriving magazine pile (6*b* of FIG. 3), then again a corresponding signal is given to the control unit 22. The light barrier 47 thus indicates that a magazine pile 6*b* has entered the scanning region of the infrared distance sensor 14 and the subsequent printing region of the ink jet matrix printing heads 20*a*, 20*b*, 20*c*.

The third light barrier 48 referred to the transport direction 7 is disposed laterally to the conveyor belt 5 downstream of the ink jet matrix printing heads 20*a*, 20*b*, 20*c*. This light barrier 48 monitors the magazine pile 6*a* exiting from the printing region of the ink jet matrix printing heads 20*a*, 20*b*, 20*c*. As soon as the magazine pile 6*a* permits the beam 51 to pass, the light barrier 48 informs the control unit 22 by a corresponding signal of the fact that the corresponding magazine pile 6*a* has left the printing region.

The operation of the two infrared distance sensors 43 and 14 is as follows:

The infrared distance sensor 43 serves for the pre-positioning of the ink jet matrix printing heads 20*a*, 20*b*, 20*c* in height. For as soon as the infrared distance sensor 43 has been activated by the interruption of the light barrier 46, this infrared distance sensor 43 scans the base height h of the leading front edge 23 and generates a corresponding control signal that is passed to the control unit 22. The latter triggers the piston cylinder drive disposed in the adjustment arm 17 in accordance with the control signal such that the ink jet matrix printing heads 20*a*, 20*b*, 20*c* are pre-positioned in a position corresponding to the height h.

During the pre-positioning the magazine pile 6*c* moves on in the transport direction 7 and finally interrupts the central light barrier 47 prior to entering the scanning region of the infrared distance sensor 14 and the subsequent printing region of the printing heads 20*a*, 20*b*, 20*c*. This interruption of the light barrier 47 activates the infrared distance sensor 14, which scans the surface contour of the upper side 15 of the magazine pile 6*c* while the latter passes by, and generates a corresponding signal for the control unit 22. Because of this signal of the infrared distance sensor 14, the position in height of the adjustment arm 17 is regulated in accordance with the contour of the passing upper side 15 by a permanent comparison being effected between the nominal value (i.e. the signal of the infrared distance sensor 14) and the actual value (i.e. the actual lift arm position in the vertical direction). In this way the ink jet matrix printing heads 20*a*, 20*b*, 20*c* are positioned in height with great sensitivity, tracking precisely the contour of the upper side 15.

The above-mentioned regulation is maintained until the light barrier 48 is released by the corresponding magazine pile. Only then renewed pre-positioning may take place via the infrared distance sensor 43. This means that the distance d between two magazine piles 6b, 6c must not fall short of a minimum determined by the conveying speed of the conveyor belt 5.

The special advantages of the embodiment according to FIG. 3 reside in that by separately scanning the base height h of an arriving magazine pile and of the actual contour of the upper side 15, a collision of the printing heads 20a, 20b, 20c with an arriving magazine pile as well as unnecessary adjustment paths of the adjustment arm 17 are avoided very reliably. Besides, a very accurate tracking of the contour of the upper side of the magazine piles (6a, 6b, 6c) can be achieved.

By the way, laser distance sensors operating on the triangulation principle are used for the infrared distance sensors.

What is claimed is:

1. A printing device for printing symbols (21a, 21b, 21c) onto a plurality of objects varying in height from h down to at least ¼ h where h is the vertical height of the objects, each of said objects having an upper side, said objects are continuously moved forward, said printing device comprising:

a transport device, comprising a drive (3,3') and a transport path (5) driven by the drive (3, 3'), said transport path for continuously moving said plurality of objects varying in height from h down to at least ¼ h at a defined speed in a transport direction, a printing unit, comprising at least one matrix printing head (20a, 20b, 20c) arranged vertically above the transport path (5), said at least one matrix printing head vertically adjustable to print on said upper side of objects varying in height from h down to at least ¼ h, said objects continuously moving in said transport direction at said defined speed, said matrix printing head remains free of contact with said plurality of objects varying in height, and an adjustment drive (24) coupled to the at least one matrix printing head (20a, 20b, 20c), said adjustment drive adjusts said matrix printing head to a height position above said upper side of said objects, said height position accommodates said objects varying in height from h down to at least ¼ h and a first scanning means (14)

arranged vertically above the transport path (7), which, related to the transport direction (7) of the objects (6a, 6b, 6c), is arranged at a distance before the printing head (20a, 20b, 20c), which scans the height position of the upper side (15) of the objects (6a, 6b, 6c) to be printed and by means of which the at least one matrix printing head (20a, 20b, 20c) can track the height position of the upper side (15) of the objects (6a, 6b, 6c) t be printed by a corresponding control of the adjustment drive (24).

2. A printing device according to claim 1, wherein each of the at least one matrix printing head is an ink jet matrix printing head (20a, 20b, 20c).

3. A printing device according to claim 1, wherein a number of matrix printing heads (20a, 20b, 20c), which corresponds to a number of lines (21a, 21b, 21c) to be printed, is arranged side by side in the transport direction (7).

4. A printing device according to claim 1, wherein the adjustment drive comprises an adjustment arm (17), which is driven by a pneumatic piston cylinder drive (24).

5. A printing device according to claim 1, wherein the scanning means comprises an infrared distance sensor (14).

6. A printing device according to claim 1, wherein the scanning means comprises an ultrasonic distance sensor.

7. A printing device according to claim 1, wherein a central control unit (22), which is controlled by a microprocessor, an input of which is connected with the scanning means (14) for receiving measuring signals of said scanning means (14), and an output of which is connected with the adjustment drive (24) of the at least one matrix printing head (20a, 20b, 20c) for controlling the adjustment drive while evaluating measuring signals of the scanning means (14) and for a printing control of the at least one printing head (20a, 20b, 20c).

8. A printing device according to claim 7, wherein the adjustment drive comprises an adjustment arm (17), which is driven by a pneumatic piston cylinder drive (24) and wherein working spaces (28, 29), which are arranged on both sides of a piston (27) of the pneumatic piston cylinder drive (24) of the at least one matrix printing head (20a, 20b, 20c), are each connected with a multipath control valve (33) controllable by the control unit (22), which multipath control valve (33) is furthermore connected with a pressure source (35) and with atmospheric pressure ($P_{atm}$), and by means of which multipath control valve (33) pressure values in both working spaces (28, 29) of the piston cylinder drive (24) can be adjusted independent from each other to values between a supply pressure ($P_{max}$) of the pressure source (35) and the atmospheric pressure ($P_{atm}$).

9. A printing device according to claim 1, comprising an incremental position detecting means (38) for detecting a vertical position of the at least one matrix printing head (20a, 20b, 20c) relative to the transport path (5), which incremental position detecting means (38) consists of a marking rail (39) at an adjustment arm (17) carrying the at least one matrix printing head (20a, 20b, 20c) and of a stationary marking sensor (41).

10. A printing device according to claim 1, comprising a second scanning means (43), which is arranged vertically above the transport path (5), which, related to the transport direction (7), is arranged before said scanning means (14), wherein the second scanning means (14) is adapted to scan a basic height (h) of a respective leading front edge (23) of the objects varying in height from h down to at least ¼ h where h is the vertical height of the objects (6a, 6b, 6c) and to generate a control signal for accordingly vertically adjusting the at least one matrix printing head (20a, 20b, 20c) to said scanned height, and wherein the first scanning means (14) is adapted to scan a contour of the upper side (15), following the leading front edge (23) of the objects (6a, 6b, 6c) and to generate a control signal for fine-positioning the at least one matrix printing head (20a, 20b, 20c) according to said contour.

11. A printing device according to claim 10, comprising first, second and third position detecting means (46, 47, 48) adapted to monitor the respective position of the objects (6a, 6b, 6c) along the transport path (5), the first position detecting means (46) being positioned, related to the transport direction (7), before the second scanning means (43) and activating said second scanning means (43) upon detection of an object (6a, 6b, 6c), the second position detecting means (47) being positioned, related to the transport direction (7), between the second and first scanning means (43, 14) and activating said first scanning means (14) upon detection of an object (6*a*, 6*b*, 6*c*), and the third position detecting means (48) being positioned, related to the transport direction (7), behind the at least one matrix printing head (20*a*, 20*b*, 20*c*) and detecting that an object (6*a*, 6*b*, 6*c*) has passed the at least one matrix printing head (20*a*, 20*b*, 20*c*).

* * * * *